US006565174B2

(12) United States Patent
Kamoshida et al.

(10) Patent No.: US 6,565,174 B2
(45) Date of Patent: May 20, 2003

(54) INK JET RECORDING DEVICE

(75) Inventors: Hitoshi Kamoshida, Hitachinaka (JP); Susumu Saito, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 10/014,411

(22) Filed: Dec. 14, 2001

(65) Prior Publication Data

US 2002/0075339 A1 Jun. 20, 2002

(30) Foreign Application Priority Data

Dec. 15, 2000 (JP) ..... 2000-381325

(51) Int. Cl.[7] ..... B41J 29/38
(52) U.S. Cl. ..... 347/12; 347/16
(58) Field of Search ..... 347/12, 16, 9, 347/40, 37

(56) References Cited

U.S. PATENT DOCUMENTS 6,203,134 B1 * 3/2001 Kakutani et al. ..... 347/15
6,464,335 B2 * 10/2002 Suzuki ..... 347/43

* cited by examiner

*Primary Examiner*—Thinh Nguyen
(74) *Attorney, Agent, or Firm*—Whitham, Curtis & Christofferson, PC

(57) ABSTRACT

When a print controller detects a nozzle that is not used for a predetermined period of duration, the print controller rewrites scan data so that the nozzle will be used in a present scan printing operation. The print controller further changes an amount of sheet feed in association with the rewritten scan data. Then, the present scan printing operation is performed. It is therefore possible to prevent any nozzles from not being used continuously for the predetermined period of time.

28 Claims, 8 Drawing Sheets

INK JET RECORDING DEVICE

BACKGROUND OF THE INVENTION

1. Field of the Invention

The present invention relates to an ink jet recording device that performs printing operations by ejecting ink from nozzles, and to a method of controlling the same.

2. Description of Related Art

Generally, a print engine for a serial-print ink jet printer includes a head, a carriage, and a sheet-feed mechanism. The head is provided with a row of nozzles for ejecting ink, and is mounted on the carriage. The sheet-feed mechanism feeds a sheet past the carriage so that the carriage is positioned in confrontation with the sheet. The carriage is oriented so that the nozzle row is aligned with the sheet-feed direction of the print sheets.

To print on a print sheet, the carriage is transported, that is, scanned, in a direction perpendicular with the sheet-feed direction. While the carriage is scanned across the print sheet, ink is ejected from the nozzles onto the print sheet, so that printing is performed in a predetermined region of the print sheet. The print sheet is then fed in the sheet-feed direction until the next region is aligned with the print head, whereupon the next region is printed on by scanning the carriage across the print sheet. By repeating these operations, the entire print sheet is printed on.

When the head of such a print engine is not used for long periods of time, ink around the nozzles can dry out and clog the nozzles or change the ink ejection characteristics of the nozzles. This reduces print quality. The print engine is therefore provided with a head cap and a refresh mechanism to prevent this problem.

The head cap is located outside from the region that the carriage moves during printing. The ink in nozzles can be prevented from drying out by covering the head with the head cap while the print engine is not printing.

With the refresh mechanism, each time a predetermined duration of time elapses, printing operations are terminated and the print head is transported to outside the printing region. Then, ink is ejected from all of the nozzles in what is called a refresh operation. By performing such a refresh operation, ink is ejected from nozzles that have not been used for printing, so that ink in these nozzles can be prevented from drying out.

SUMMARY OF THE INVENTION

However, printing operations must be stopped each time the predetermined duration of time elapses so that the print head can be transported outside the printing region and so a refresh operation can be performed. This reduces printing speed. Also, ink is ejected from all nozzles during a refresh operation, even from nozzles without risk of being clogged by dried ink. This wastes ink.

It is an objective of the present invention to overcome the above-described problems, and provide an ink jet printer and a method of controlling the same to require no, or fewer, refresh operations that require termination of printing operations, thereby reducing the amount that printing speed is reduced and reducing consumption of ink.

In order to attain the above and other objects, the present invention provides an ink jet recording device, comprising: a print head formed with a plurality of nozzles arranged in a first predetermined direction; a print head scanning mechanism scanning the print head in a second predetermined direction substantially perpendicular to the first predetermined direction; a sheet feeding mechanism feeding a print sheet relative to the print head in a sheet feeding direction that is substantially parallel to the first predetermined direction; a print engine driving the print head to perform successive scan printing operations to eject ink from the nozzle, the print engine driving the sheet feeding mechanism to feed the print sheet before controlling the print head to perform each scan printing operation: and a print controller controlling the print engine, the print controller including a scan data preparation processor preparing scan data for each scan printing operation, based on the nozzle configuration of the print head and based on print data; a sheet transportation processor controlling a sheet feed amount, by which the sheet feeding mechanism feeds the print sheet; a detecting unit detecting how each nozzle is used in the successive scan printing operations; and a scan data rewriting unit rewriting the scan data and changing the amount of sheet feed selectively based on the detected result.

The detecting unit may detect, before starting one scan printing operation, whether some nozzle has not been used for a predetermined period of time. When the detecting unit detests some unused nozzle that has not been used for the predetermined period of time, the scan data rewriting unit may rewrite the scan data for the subject scanning operation so as to use the detected unused nozzle during the subject scanning operation, and change, from a predetermined amount, the amount of sheet feed, by which the sheet is to be fed before the subject scan printing operation, in accordance with the rewritten scan data. When the detecting unit detects no unused nozzle, the scan data rewriting unit may perform no rewriting operation and perform no sheet feed amount changing operation.

Alternatively, the scan data rewriting unit may rewrite the scan data so that each nozzle will be used at least once while several scan printing operations are successively conducted to print a predetermined number of page's worth of image.

For example, the detecting unit may detect, before starting the several scan printing operations to print the predetermined number of page's worth of image, whether some nozzle will be used less than a threshold number of times. When the detecting unit detects that some nozzle will be used less than the threshold number of times, the scan data rewriting unit may rewrite the scan data for the several scan printing operations so as to use the detected nozzle at least the threshold number of times during the several scan printing operations, and change the amount of sheet feed, by which the sheet is to be fed during the several scan printing operations, based on the rewritten scan data.

According to another aspect, the present invention provides a method of controlling an ink jet recording device, the ink jet recording device including: a print head formed with a plurality of nozzles arranged in a first predetermined direction; a print head scanning mechanism scanning the print head in a second predetermined direction substantially perpendicular to the first predetermined direction; a sheet feeding mechanism feeding a print sheet relative to the print head in a sheet feeding direction that is substantially parallel to the first predetermined direction; and a print engine driving the print head to perform successive scan printing operations to eject ink from the nozzles, the print engine driving the sheet feeding mechanism to feed the print sheet before controlling the print head to perform each scan printing operation; the method comprising the steps of: preparing scan data for each scan printing operation, based on the nozzle configuration of the print head and based on print data; detecting how each nozzle is used in the successive scan printing operations; rewriting the scan data and changing the amount of sheet feed selectively based an the detected result; and controlling the print engine to drive the sheet feeding mechanism to feed the print sheet by the selectively-rewritten sheet feed amount, and controlling the print engine to drive the print heed to eject ink based on the selectively-rewritten scan data.

BRIEF DESCRIPTION OF THE DRAWINGS

The above and other objects, features and advantages of the invention will become more apparent from reading the following description of the embodiment taken in connection with the accompanying drawings in which.

DETAILED DESCRIPTION OF PREFERRED EMBODIMENT

Figure 1:
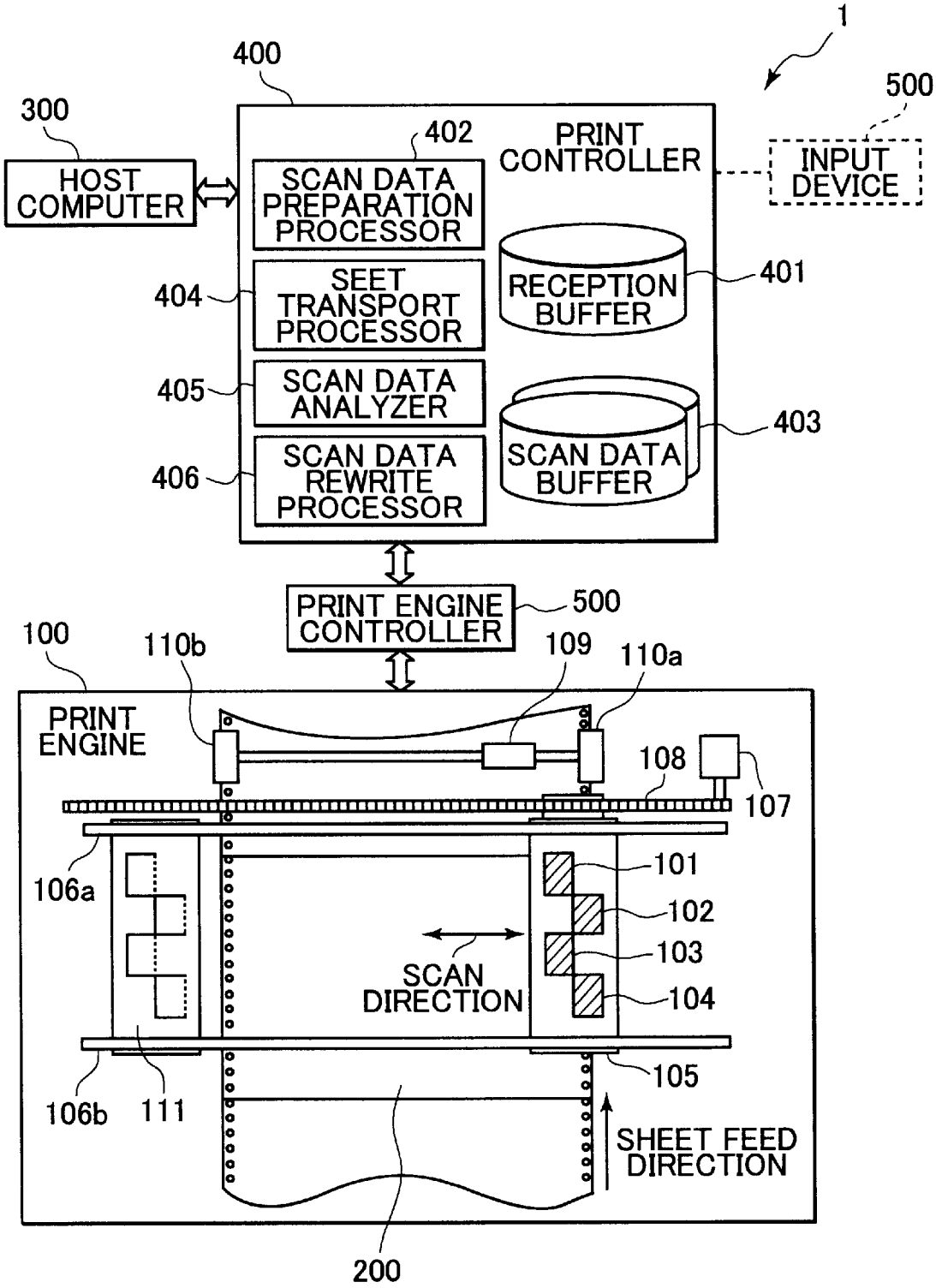
FIG. 1 is a block diagram showing components of printer system according to en embodiment of the present invention.

An ink jet recording device according to a preferred embodiment of the present invention will be described while referring to the accompanying drawings wherein like parts and components are designated by the some reference numerals to avoid duplicating description.

FIG. 1 is a block diagram showing a printer system 1 according to the present embodiment. This printer system 1 includes a serial type print ink jet printer 100, a printer controller 400, and a printer engine controller 500. A host computer 300 is connected to the printer controller 400.

The ink jet printer 100 includes four print heads 101 to 104, a carriage 105, a pair of guide rails 106*a*, 106*b*, a carriage motor 107, a belt 108, a sheet-feed motor 109, a pair of tractors 110*a*, 110*b*, and a head cap 111.

The sheet-feed motor 109 and the tractors 110*a*, 110*b* are for transporting a print sheet 200 in a predetermined sheet-feed direction.

The carriage 105 is mounted on the guide rails 106*a*, 106*b*. The carriage motor 107 and the belt 108 transport the carriage 105, as guided by the guide rails 106*a*, 106*b*, across the print surface of the print sheet 200 in a predetermined scan direction, which is perpendicular to the sheet-feed direction.

Each of the heads 101 to 104 is formed with a plurality of nozzles for ejecting ink. The heads 101 to 104 are mounted on the carriage 105.

The head cap 111 is located outside of the printing range. The head cap 111 is for sealingly covering the heads 101 to 104 when the carriage 105 moves outside the printing range to the position confronting the head cap 111. The head cap 111 can prevent ink in the nozzles from drying out.

The nozzles formed in each head 101 to 104 are aligned with the sheet-reed direction of the print sheet 200, or said differently, in a direction perpendicular to the scan direction of the carriage 105, and consequently perpendicular to the scan direction of the heads 101 to 104. Each nozzle in the heads 101 to 104 is connected to a corresponding ink chamber (not shown). Ink is ejected from a nozzle by increasing the pressure in the ink filling the corresponding ink chamber.

The heads 101 to 104 are controlled to eject ink onto the print sheet 200 at timings synchronized with movement of the carriage 105. Printing of one scan is completed each time the carriage 105 is transported a predetermined amount that defines the printing range.

Figure 2:
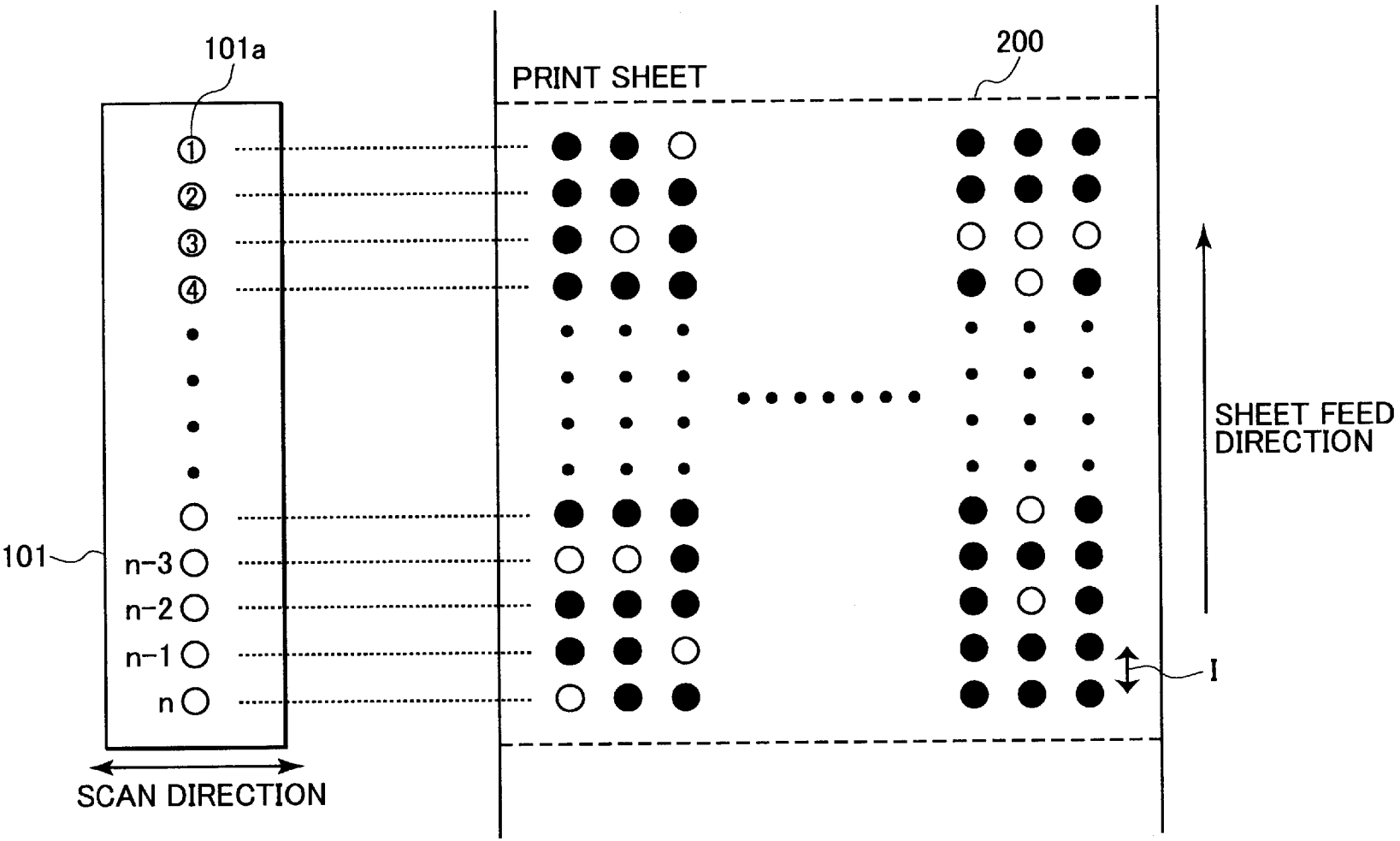
FIG. 2 is a schematic view showing relations between nozzles, nozzle numbers and lines printed in the serial ink jet printer in the printer system of FIG. 1.

As shown in FIG. 2, each head 101–104 (head 101, in this description) includes n-number of nozzles 101*a*, which are aligned in a row parallel to the sheet feed direction, and so prints n-number of rows in a single scan print operation (where n is an integer greater than one (1)). Each row extends in the scan direction. Thus, each head 101 to 104 can print a number of lines that correspond to the number of nozzles, which are aligned in the longitudinal direction of the head 101 to 104, during the single scan printing operation.

After thus printing the n number or lines during one scan printing operation, in order to print the next n number of lines in a succeeding portion of the already-printed n number of lines, the cheat-feed motor 109 drives the tractors 110*a*, 110*b* to feed the print sheet 200 by a predetermined sheet-feed amount equivalent to the n-lines. It is now assumed that the n number of nozzles can print n number of lines in a manner that the n number of lines are arranged by a predetermined interval I. In this case, the predetermined sheet-feed amount has a value or I×n. Accordingly, the first line in the next met of n number of lines will be printed on the sheet 200 at a proper location which is separated, by the interval I, from the last (n-th) line in the present set or n number of lines.

The host computer 300 is for supplying print data, which is used for printing, to the print control portion 400. The print control portion 400 includes: a reception buffer 401, a scan data preparation processor 402, a scan data buffer 403, a sheet transport processor 404, a scan data analyzer 405, and a scan data rewrite processor 406.

The reception buffer 401 is for storing print data when the print controller 400 receives the print data from the host computer 300.

The scan data preparation processor 402 is for successively preparing scan data for successive scan printing operations, based on the print data in the reception buffer 401 and based an other information, including the information on the nozzle configuration of the heads 101 to 104 mounted on the carriage 105. Every time the scan data preparation processor 402 prepares one group of scan data for one scan printing operation, the scan data preparation processor 402 stores the thus prepared one group of scan data in the scan data buffer 403.

The sheet transport processor 404 is normally set with data of the predetermined sheet-feed amount (I×n).

As will be described later, every time when the scan data preparation processor 402 prepares one group of scan data for one scan printing operation and stores the scan data group in the scan data buffer 403, the scan data analyzer 405 determines whether or not the scan data group should be modified. When the scan data analyzer 405 determines that the scan data group should be modified, the scan data rewrite processor 406 performs modifying operation to modify the scan data group and to change the sheet-feed amount from the predetermined sheet-feed amount (I×n). The thus modified scan data group is written over the original scan data group in the scan data buffer 403. The modified sheet-feed amount is set in the sheet transport processor 404. On the other hand, when the scan data analyzer 405 determines that the scan data group should not be modified, the scan data rewrite processor 406 does not perform the modifying operation. Accordingly, the scan data stored in the scan data buffer 403 is not modified. The predetermined sheet-feed amount (I×n) got in the sheet transport processor 404 is not changed.

The print engine controller 500 is for driving the sheet-reed motor 109 and the carriage motor 107 once the single scan's worth of scan data is thus prepared and selectively modified and the sheet-feed amount is selectively modified. More specifically, the print engine controller 500 first drives the sheet-feed motor 109 to feed the print sheet 200. At this time, the sheet transport processor 404 controls the print engine controller 500 to drive the sheet-feed motor 109 so that the sheet-feed motor 109 will feed the print sheet 200 by the sheet-feed amount presently set in the sheet transport processor 404. The print engine controller 500 then drives the heads 101 to 104 to eject ink for printing based on the selectively-modified scan data, while driving the carriage motor 107 to move the carriage 105 in the scan direction.

When the present scan's worth of printing is finished, the scan data preparation processor 402 prepares another group of scan data for printing in the next scan. Once the next group of scan data has been prepared, the determination operation, the selectively-executed modifying operation, the sheer feed operation, and the scan print operations are executed in the same manner as described above. These scan data preparation operations, determination operations. selectively-executed modifying operations, sheet-feed operations, and scan printing operations are repeated until no print data remains unprinted in the reception buffer 401.

Thus, according to the present embodiment, the successive scans' worth of printing are continuously executed, while repeatedly detecting whether some nozzles are not used for ink election for long periods of time and selectively modifying the scan data and the sheet-feed amount based on the detected results so that the detected unused nozzle will be used for ejecting ink. It is therefore possible to prevent ink from drying in the unused nozzles, without performing the refreshment operation.

The scan data analyzer 405 is provided for detecting whether some nozzles are not used for ink ejection for long periods or time. The scan data rewrite processor 406 is provided for selectively modifying the scan data and the sheet-feed amount based on the detected results. The scan data analyzer 405 and the scan data rewrite processor 406 will be described below in greater detail.

The scan data analyzer 405 successively searches through scan data groups, to be used for the successive scans' worth of printing operations, in order to find some nozzle that has not been used for printing for long periods of time.

The scan data analyzer 405 includes a plurality of ("n" number of, in this example) timers (not shown) in one to one correspondence with the "n" number of nozzles in each head 101–104. Each timer is provided to detect whether a corresponding nozzle is not used continuously for a long period of time, by measuring whether the long period of time has elapsed since the corresponding nozzle has been used latest.

More specifically, when the timer is started up, the timer is first set to an initial value T, which is a predetermined positive value other than zero (0) and which is indicative of the length of a predetermined duration of time. The timer then decrements its value from the initial value T in association with elapse of time if the corresponding nozzle is used during some scan's worth of printing operation, the timer is reset to the initial value T and then is restarted. On the other hand, when the timer reaches zero (0) during some scan's worth of printing stage, it can be determined that the corresponding nozzle has not been used continuously for the predetermined duration.

It is noted that the nozzles print the corresponding lines during each scan's worth of printing operation as described above with reference to FIG. 2. Accordingly, during each scan's worth of printing stage, the scan data analyzer 405 analyzes the scan data of the subject scan's worth of printing, and selectively resets the timers for the nozzles based on the analyzed result. That is, if scan data for one line that corresponds to some nozzle includes data for ejecting ink, the scan data analyzer 405 resets a timer corresponding to the subject nozzle to the initial value T, and then restarts the timer.

The scan data analyzer 405 determines whether some nozzle has not been used for the predetermined period of time T, by judging whether some timer reaches a zero (0) value. The can data analyzer 405 performs this determination operation at the timing when the scan data preparation processor 402 prepares one group of scan data for one scan's printing operation to be executed (present scan printing operation), and stores the scan data group in the scan data buffer 403.

The scan data rewrite processor 406 performs the modifying operation when the scan data analyzer 405 determines that there exists some nozzle that has not been used for the predetermined period of time T. More specifically, the scan data rewrite processor 406 first finds another nozzle that is located in the vicinity of the unused nozzle and that is scheduled to be used for ejecting ink during the present scan printing operation. Based on the searched results, the scan data rewrite processor 406 executed scan data rewrite processes on the present group of scan data, by changing, or replacing the scan data.

The scan data rewrite processor 406 then changes the sheet-feed amount from the predetermined sheet-feed amount (I×n), in order to allow the unused nozzle to print the modified scan data at a proper line position.

It is noted that the sheet transport processor 404 is normally set with the predetermined sheet-feed amount (I×n) When the scan data rewrite processor 406 changes the sheet-feed amount from the predetermined sheet-feed amount (I×n), the scan data rewrite processor 406 sets the changed sheet-feed amount value in the sheet transport processor 404.

It is also noted that each of the scan data preparation processor 402, the sheet transport processor 404, the scan data analyzer 405, and the scan data rewrite processor 406 in the print controller 400 can actually be realized by a compact computer and its associated computer program.

The printing control process executed by the print controller 400 will be described below in greater detail while referring to the flowchart of FIG. 3.

When the printing control process is started, first in S610, the timers for all the nozzles are reset to the predetermined initial value T, and started to decrement the value.

In S620, the scan data preparation processor 402 reads one group of print data, to be used for the present scan's worth of printing operation (first scan's worth of printing operation, in this example), from the reception buffer 401, converts the print data into one group of scan data, and stores the scan data group in the scan data buffer 403.

In S630, the scan data analyzer 405 judges whether or not some timer reaches zero (0). In this case, because the printing control process has just started, no timer reaches zero (0). Accordingly, the scan data analyzer 405 determines that the predetermined duration of time has not yet elapsed in any nozzles (no in S630). Therefore, the program directly proceeds to S650, without executing the routine of S640 for rewriting scan data and changing the sheet-feed amount. Because the process of S640 for changing the sheet-feed amount is not executed, the predetermined sheet-feed amount (I×n) is continuously set in the sheet transport processor 404.

In S650, the scan data analyzer 405 first analyzes the present scan data, and detects whether or not the scan data includes data for ejecting ink from some nozzle. If the scan data includes data for ejecting ink from some nozzle, the print data analyzer 405 resets the timer for the subject nozzle to the initial value T.

The print engine controller 500 then drives the sheet-feed motor 109 to perform a sheet-feed operation. In this case, the sheet transport processor 404 controls the print engine controller 500 to control the sheet-feed motor 109 to feed the print sheet 200 by the predetermined sheet-feed amount (I×n). Then, the print engine controller 500 drives the heads 101 to 104 to eject ink based on the present scan data group, while driving movement of the carriage 105.

When the printing operation of S650 Is finished, the print data in the reception buffer 401 is observed in S660 to see whether printing of all print data has been performed. If some print data still remains unprinted in the reception buffer 401 (no in S660), the routine returns to S620.

In S620, another group of print data, to be used for the next scan's a worth of printing operation (second scan's worth of printing operation, in this example) is read from the reception buffer 401, converted into one group of scan data, and stored in the scan data buffer 403.

In S630, the roan data analyzer 405 judges again whether or not some timer reaches zero (0). If some timer reaches zero (0) at this stage, the scan data analyzer 405 determines that the predetermined time has elapsed at a corresponding nozzle (yes in S630). Accordingly, the program proceeds to the routine or S640 to rewrite the scan data and to change the sheet-feed amount from the predetermined sheet-feed amount (I×n).

In S640, the scan data rewrite processor 406 modifies the scan data, and changes the sheet-feed amount from the predetermined sheet-feed amount (I×n) in a manner, to be described later, so that the unused nozzle can be used in the present (second) scan's worth of print operation. The scan data rewrite processor 406 sets the modified sheet-feed amount in the sheet transport processor 404. The timer for the unused nozzle is reset and restarted.

When the scan data rewrite and sheet-feed amount change routine of S640 are completed, the program proceeds to S650 to perform the present (second) scan printing operation in the same manner as described above. It is noted, however, that in this scan printing operation, the changed sheet-feed amount and the modified scan data is used. That is, the modified scan data group is first analyzed, and timers for all the nozzles for ejecting ink are reset and restarted. Then, the sheet transport processor 404 controls the print engine controller 500 to drive the sheet-feed motor 109 to feed the sheet 200 by the modified sheet-feed amount. The print engine controller 500 drives the heads 101 to 104 to eject ink based on the modified scan data, while driving movement of the carriage 105. After the printing operation is finished, the setting of the sheet transport processor 404 is returned from the modified sheet-feed amount back to the predetermined sheet-feed amount (I×n).

Thereafter, the program proceeds to S660. If some print data still remains unprinted in the reception buffer 401 (no in S660), the routine returns to S620. Then, the processes of steps S620–S660 are repeatedly executed in the same manner as described above until printing for all the print data has been completed (yes in S660), whereupon printing operations are ended.

In this way, according to the present embodiment, even when some nozzle is not used for a long period of time, a refresh operation is not executed. Accordingly, the successive scans' worth of printing operations are continuously executed without termination, or the carriage 105 is not driven to move outside of the printing range.

Next, the scan data rewrite and sheet-feed amount change process of S640 will be described in greater detail while referring to FIG. 4.

First, in step 641, the timers for all the nozzles are searched to identify the timer that reaches zero (0). A nozzle that corresponds to the zero-reaching timer is determined as an unused nozzle, which has not been used for the predetermined duration T. It is now assumed that the nozzle number or the unused nozzle is N (where N is an integer greater than or equal to 1 and smaller than or equal to n).

Next, in stop 643, by searching the scan data group stored in the scan data buffer 403, nozzle candidates are set to one or more nozzles, other than the unused nozzle N, that are scheduled to be used in the present scan's worth of printing operation, and that have nozzle numbers smaller than the nozzle number N of the unused nozzle N. Then, a replacement nozzle M is selected among the one or more nozzle candidates. That is, the replacement nozzle M is set to one nozzle, whose nozzle number M (where M is an integer greater than or equal to 1 and smaller than N) is the nearest to the nozzle number N among the nozzle candidates.

In this way, the one or more nozzle candidates are set to those nozzle(s) that are located in the downstream side of the unused nozzle N in the sheet feeding direction. The replacement nozzle M Is selected as the nozzle that is the nearest to the unused nozzle N among the one or more nozzle candidates.

Next, in step 644, a nozzle data replacement process is executed for rewriting the scan data, for the present scan's worth of printing, to replace the scan data for the unused nozzle N with the scan data for the replacement nozzle M.

In step 645, the present group of scan data is updated using the scan data replaced in step 644.

It is noted that the print sheet 200 needs to be transported, before starting of the present scan's worth of printing, in conformity with the newly-produced group of scan data. Therefore, in step 646, the sheet feed amount of the print sheet 200 Is changed from the predetermined sheet-feed amount (I×n), based on the difference (N−M) between the nozzle number N of the unused nozzle N and the nozzle number M of the replacement nozzle M. That is, the sheet-feed amount is changed from (I×n) into $(I \times n) \times [n-(N-M)]/n$ $(=I \times n)-(I \times (N-M)))$.

The thus changed sheet-feed amount is set in the sheet transport processor 404.

When the scan data group and the sheet-feed amount is thus modified, in step 647, the timer corresponding to the unused nozzle N is reset to the initial value T, and is restarted.

Thus, the scan data rewriting and sheet-feed amount changing routine of S640 is ended. Then, the program proceeds to S650 in the main routine of FIG. 3.

Next will be described how the printing control process is executed in one example shown in FIG. 5.

In this example, each print head 101–104 has eight nozzles. Nozzle numbers N1–N8 are assigned to the eight nozzles so that the nozzle number increases in a direction opposite to the sheet feed direction. It is now assumed that the printing operation of S650 has just been completed to print a region L1 on the sheet 200 as shown in portion A of FIG. 5. That is, lines D1–D8 have just been printed by the nozzles N1–N8, respectively. It is noted that the lines are arranged in an orientation that the line number increases in the direction opposite to the sheet feed direction. The nozzles N1–N8 print lines so that the lines are arranged at a predetermined interval I.

It is noted that as apparent from this figure, the nozzles N1–N4 and N6–N8 are used to eject ink at least once during the printing process of S650 for the region L1, and timers for those nozzles N1–N4 and N6–N8 are reset and restarted. However, the nozzle N5 Is not used in S650. It is also assumed that the nozzle N5 has not been used before the region L1, and the predetermined duration T has elapsed in the timer that corresponds to the nozzle N5.

Assuming that some print data remains unprinted in the reception buffer 401 (no in S660), the program returns to S620. In S620, one group of print data for the next scan's worth of printing, that is, for the next print region L2, is read from the reception buffer 401, converted into one group of scan data, and stored in the scan data buffer 403. It is noted that the print region L2 is made from lines D9–D16. Accordingly, the one group of scan data is prepared so that nozzles N1–N8 will print lines D9–D16, respectively, as shown in portion A of FIG. 5. That is, the one group of scan data is prepared so that lines D9–D16 are assigned to the nozzles N1–N8, respectively.

In S630, it is judged whether there is some timer that has reached zero (0). In this example, because the timer for nozzle N5 has reached zero (yes in S630), the program proceeds to the routine of S640.

In the routine of S640, first, in S641, the unused nozzle N5 is detected as an unused nozzle N. Then, in S643, the scan data analyzer 405 examines the one group of scan data for the print region L2, and searches scan data of nozzles, with a smaller nozzle number than the unused nozzle N5, that are scheduled to eject ink during the scan print operation for the print region L2. Because nozzles N1 to N4 have nozzle numbers lower than unused nozzle N5, scan data of lines D9 and D12 a searched in this example. Of the scan data for these four lines D9 to D12, only scan data for lines D9 and D10 includes data for ejecting ink droplets. Nozzles N1 and N2, which correspond to lines D9 and D10 are therefore determined as nozzle candidates. Because nozzle N2 is closer to nozzle N5 than nozzle N1, nozzle N2 is determined in S643 as the replacement nozzle M for the nozzle N5.

Then, in step 644, scan data, for the present scan printing operation is rewritten in order to use the nozzle N5 to print line D10 instead of using the nozzle N2. In order to prepare scan data so that the nozzle N5 Will print line D10 in the present scan print operation, the scan data is rewritten so that nozzle N1 will print line D6 as shown in part B of FIG. 5, and so that the nozzle N5 will print line D10.

In this way, in S644, the correspondence relationship between the plurality of nozzles N1–N8 and the date lines D9–D16 is changed by shifting the positions of the nozzles relative to the data lines by the amount equivalent to the difference (3, in this case) between the nozzle number N (N5, in this case) of the unused nozzle N and the nozzle number M (N2, in this case) of the replacement nozzle M so that the unused nozzle N (N5) will correspond to the data line D10 that has been prepared for the replacement nozzle M (N2).

It is noted, however, that as a result of rewriting the scan data in this manner, nozzles N1 to N3 will be assigned with scan data for printing line D6 to D5, which have already been printed during printing of region L1. So if the rewritten scan data were used as is, lines D6 to D8 will be printed again. To prevent this potential problem, scan data for the present scan print operation is prepared so that the nozzles N1 to N3 will be driven using blank scan data which does not drive the nozzles to eject ink.

In this way, non-ejection data is set to all of successive nozzles N1–N3, the total number of which is equal to the difference (3) between the nozzle number N5 of the unused nozzle N and the nozzle number N2 of the replacement nozzle M and which includes the nozzle N1 with the smallest nozzle number N1.

Thus, in S644, the scan data rewrite processor 406 shifts scan data for lines D9–D13 from the original locations for nozzles N1–N5 to the new locations for nozzles N1–N8, and sets non-ejection data for the locations for nozzles N1–N3.

Then, in S645, the scan data rewrite processor 406 produces a group of modified scan data so that the nozzles N1–N3 will eject no ink and nozzles N4–N8 will print lines D9–D13, that is, a print region L3. The scan data rewrite processor 406 then writes the thus produced group of modified scan data over the original scan data group, which has been prepared and stored in the scan data buffer 403 in S620.

Then, the process of S546 is conducted to deal with a further potential problem that occurs due to the above corrective action. It is noted that the print sheet 200 has to be fed before starting the present printing operation. However, if the print sheet 200 were fed by the predetermined amount ($I \times n$ (where $n=8$)) that is equivalent to the "n (=8)"–number of nozzles (length of the head), the three lines corresponding to the nozzles N1 to N3 will become blank because the nozzles N1 to N3 are provided with scan data for not ejecting ink.

To avoid this potential problem, in S646, the sheet-feed amount is reduced from the predetermined sheet-feed amount ($I \times 8$: represented by L2 In section B of FIG. 5) by the length of the three nozzles N1 to N3, that is, by the distance ($I \times (5-2)$) equivalent to the difference between the nozzle number N5 of the unused nozzle N and the nozzle number N2 of the replacement nozzle M. Accordingly, the sheet feed amount is reduced into an amount that is as small as $5/8$ ($=[8-(5-2)]/8$) of the normal, predetermined sheet-feed amount ($I \times 8$). The thus adjusted sheet-feed amount is represented by L3 in section B of FIG. 5.

Then, in S647, the timer for the nozzle N5 is reset to the initial value T, and is restarted.

Then, the printing process is executed in S650. That is, first, the sheet 200 is fed by the amount, equivalent to region L3, which is $5/8$ of the predetermined sheet-feed amount ($I \times 8$) equivalent to region L2. Then, the nozzles N1–N8 are driven to elect ink. That is, nozzles N1–N3 are driven not to eject ink, and nozzles N4–N8 are driven to print lines D9–D13. Accordingly, the nozzle N5, which has not been used, can be used to eject ink to print the line D10. Section B of FIG. 5 shows the printed result obtained after this printing operation is completed in the print region L3.

After the printing operation of S650 for region L3 is completed, if some print data still remains unprinted in the reception buffer 401 (no in S660), the program returns to S620. In S620, one group of print data for the next print region L4 (shown in portion C of FIG. 5) Is read out from the reception buffer 401, converted into scan data, and stored in the scan data buffer 403. The presently-read out print data group is for printing lines D14–D21. It is noted that the lines D14–D16 are included also in the region L2 a shown in section A of FIG. 5 but are not printed in the region L3 Accordingly, the lines D14–D16 are included in the scan data group to be printed in the region L4.

Assuming that the predetermined duration has not elapsed in any timers (no in S630), the program proceeds directly to S650, where a printing operation is normally executed for the print region L4. That is, the sheet 200 is fed by the predetermined distance (I×8) equivalent to the region L4, and the nozzles N1–N8 are used to print lines D14–D21, respectively. Thus, lines D14–D16, which have been read in the preceding scan printing process but which have not been printed, are printed in the present scan printing process.

Thus, according to the present embodiment, even when the nozzle N5 is determined as unused nozzle after printing the region L1, a refreshment operation is not executed before starting the next scan print operation. It is possible to continuously perform the successive scanning printing operations. It is unnecessary to terminate the scan print operation.

Figure 3:
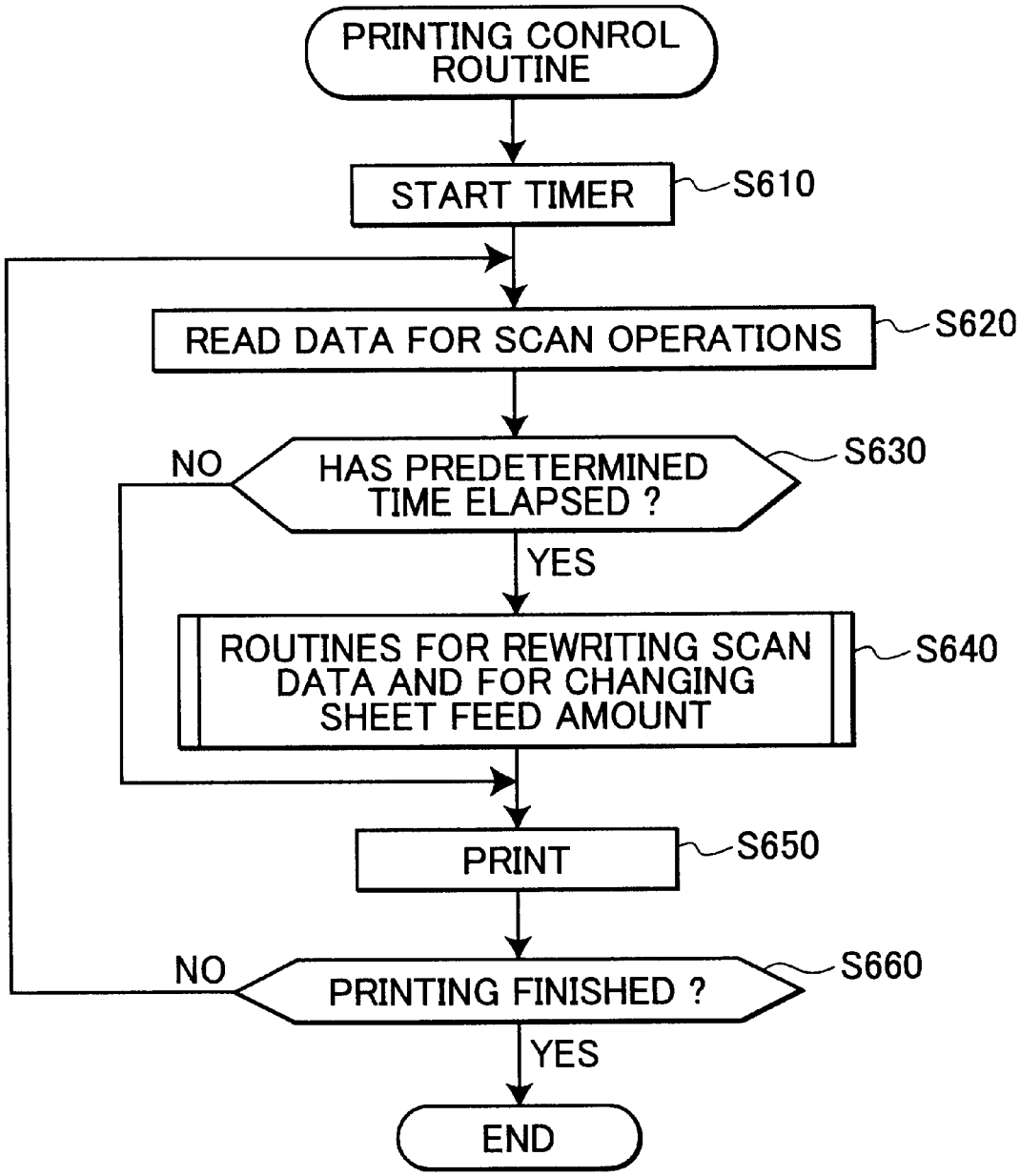
FIG. 3 is a flow chart showing a print control process that is executed by the print controller in the printer system of FIG. 1.
Figure 4:
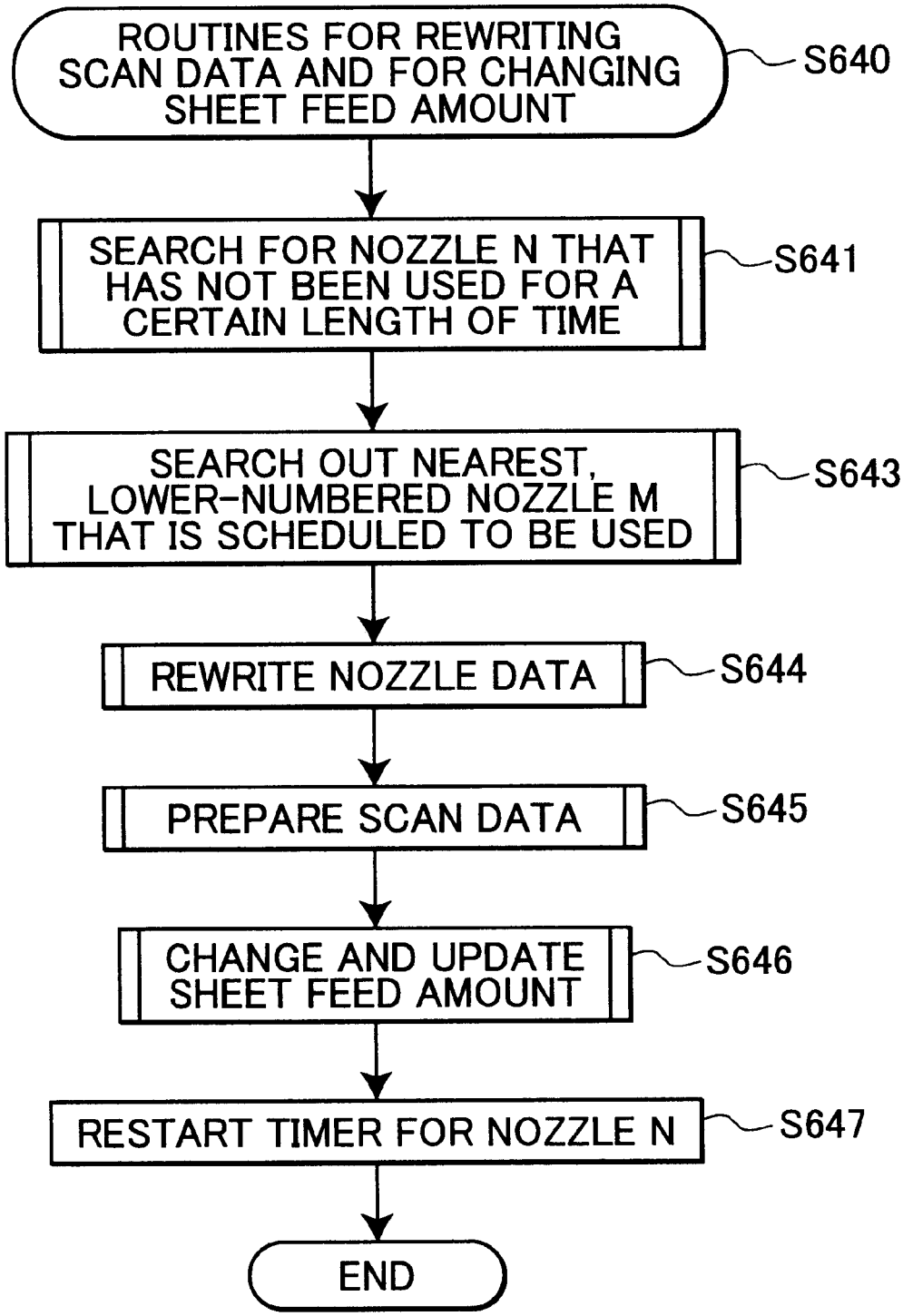
FIG. 4 is a detailed flow chart showing the scan data rewrite and sheet-feed amount changing process in the control process of FIG. 3.

Although not shown in the flowcharts of FIGS. 3 and 4, there will possibly arise the case where more than one timers reach zero (0) in S630. In this case, it is impossible to properly modify the scan data to cause the plural unused nozzles to eject ink. There will also possibly arise the case where one group of scan data, prepared in S620, has no data for ejecting ink. Also in this case, it is impossible to modify the scan data so as to cause the unused nozzle to eject ink. In these cases, a refreshment operation may be conducted.

Figure 5:
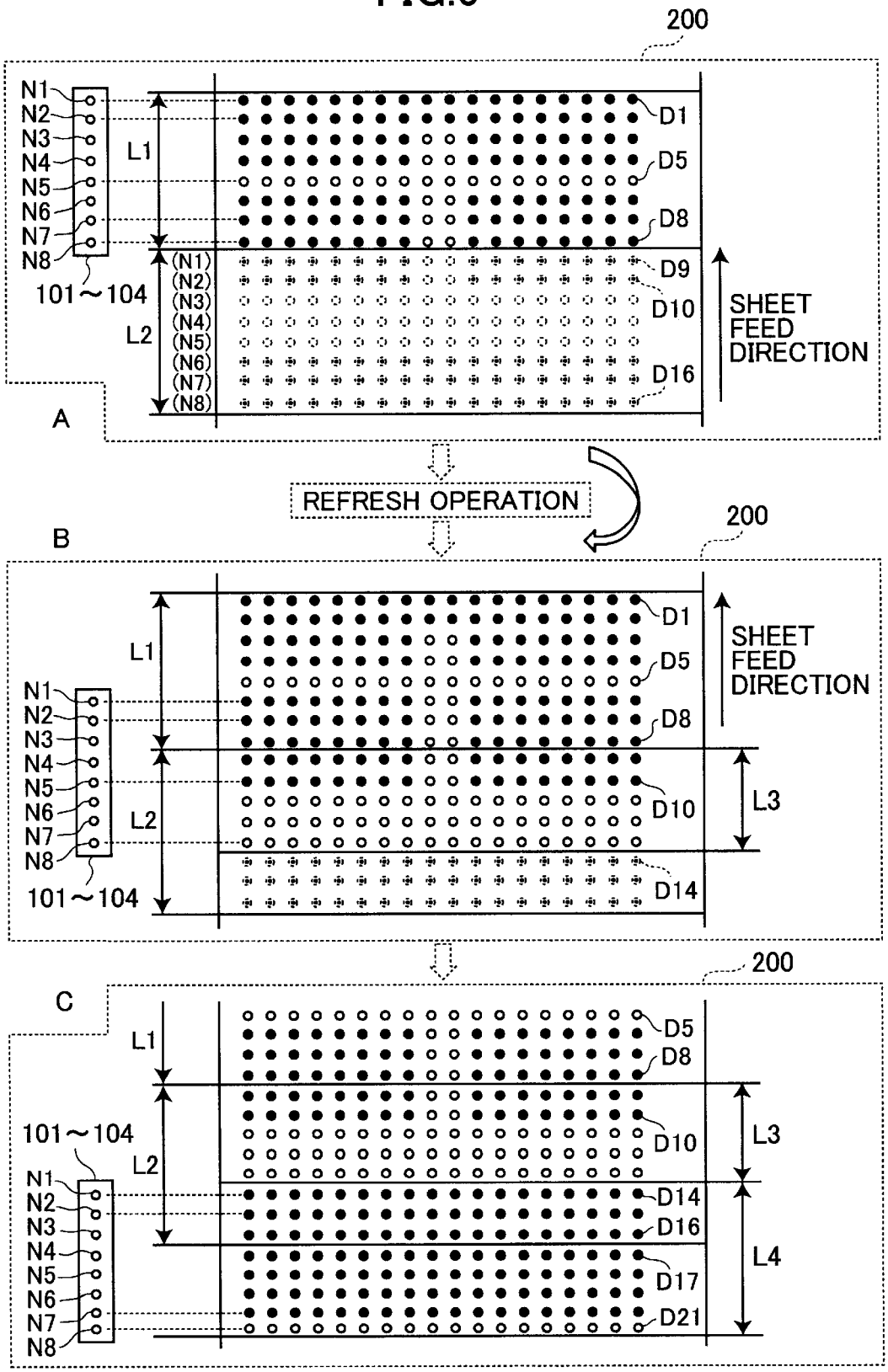
FIG. 5 is a schematic view showing an example of the printing operation according to the printing control of FIGS. 3 and 4, wherein portion A shows a resultant print sheet after a region L1 has been printed, Section B of FIG. 5 shows the printed result obtained after the next region L3 has been printed, and Section C of FIG. 5 shows the printed result obtained after the next region L4 has been printed.

For example, if more than one timers reach zero (0) at the time when the region L1 has been printed as shown in the section A of FIG. 5, or if the group of scan data, prepared in S620 for the region L2, has no data for ejecting ink, the refreshment operation is performed, after the printing of the region L1, as indicated by broken line in FIG. 5. That is, the carriage 105 is transported to outside the printing region, and the heads 101–104 are controlled to forcibly eject ink from all the nozzles.

It is noted that the above description is merely an example showing how the scan data is changed for an unused nozzle. However, the scan data preparation process is not particularly limited by the above-described example.

The above-described example is directed to the case where each print head 101–104 has eight nozzles. However, the number of the nozzles in each print head 101–104 is not limited to eight, but may be other values. For example, each print head 101–104 may be formed with 128 nozzles.

As described above, according to the present embodiment, by replacing and rewriting the scan data and by updating the sheet feed amount to correspond to the replaced and rewritten scan data, nozzles that have not been used for the predetermined duration of time can be used. By adjusting the sheet feed amount shorter than the "n" nozzles' worth of length, the total number of scan operations, required for completely printing the entire print data, will increase. However, the number of times, the refreshing operation is performed during printing of the entire print data, is reduced. It is noted that it takes approximately 100 ms for one scan, but this duration for one scan is much shorter than the duration for the refreshment operation, which takes a few seconds. Therefore, it is possible to reduce the amount that printing speed is reduced and the amount that ink is consumed wastefully during the refreshment operation because less refreshment operations are required in the present embodiment.

In the above-described embodiment, the scan data buffer 403 has a memory area capable of storing only one group of scan data to be used during one scan printing operation. Accordingly, every time the scan data preparation processor 402 prepares one group of scan data, the one group of scan data is stored in the scan data buffer 403, and one scan printing operation is conducted after selectively modifying the scan data group.

However, the scan data buffer 403 may have a larger memory area that is capable of storing a plurality of groups of scan data to be used during a plurality of successive scan printing operations. In this case, every time the scan data preparation processor 402 prepares plural scan data groups, the scam data preparation processor 402 may store the thus prepared scan data groups in the scan data buffer 403.

Following are modifications of the present embodiment when the scan data buffer 403 has such a large memory area.

First Modification

In the above-described embodiment, scan data is rewritten fox unused nozzle while the successive scans' worth of printing is being performed.

However, scan data could be prepared, in advance, for predetermined one or more pages. In this case, before starting the printing operation for the predetermined number of pages, it is possible to detect how much times each nozzle will be used while those pages are being printed. In addition, some setting unit can be provided to set a minimum number of times that each nozzle has to be used during printing operation for the predetermined number of pages. The minimum number can be optionally set by a user. If a nozzle that will not be used at all or a nozzle that will be used less than the minimum number of times is detected, the present modification rewrites the scan data and changes the sheet feed amount so that the nozzle will be sufficiently used while the predetermined number of pages is printed.

More specifically, according to the present modification, an input device, such as a keyboard and a mouse, 600 is connected to the print controller 400 as indicated by broken line in FIG. 1. Before starting the printing operation, a user can input his/her desired number Th as the minimum number of times that each nozzle has to be used during printing operation for the predetermined number of pages (one page, in this example). The number Th will be referred to as threshold number Th hereinafter.

Figure 6:
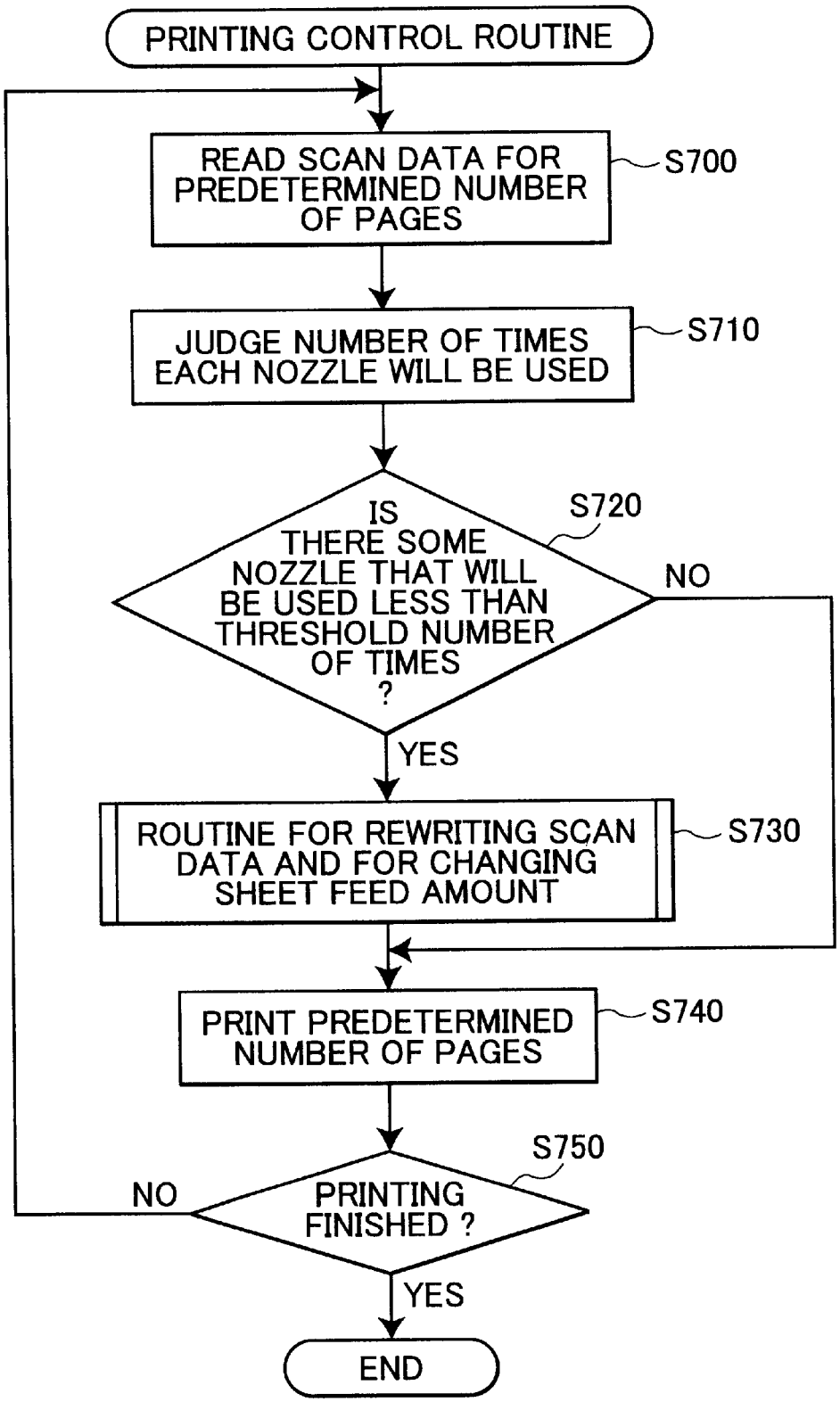
FIG. 6 is a flow chart showing a print control process according to a first modification.

According to this modification, the printing control is performed as shown in FIG. 6.

First, in S700, the scan data preparation processor 402 reads print data for the predetermined number of pages (one page, in this example) from the reception buffer 401, and converts the print data into a plurality of groups of scan data so that the plurality of groups of scan data will be successively used in a plurality of scan printing operations to print the predetermined number of pages. The thus prepared scan data groups are stored in the scan data buffer 403.

Then, in S710, all the scan data groups are analyzed to determine the number of times each nozzle will be used to eject ink during the printing operation of the predetermined number of pages by using the scan data groups.

In S720, it in judged whether or not there is some nozzle that will be used less than the threshold number Th of times.

If it is determined that there is some nozzle N that will be used less than the threshold number Th of times (yes in S720), the scan data rewriting and sheet-feed amount changing routine is conducted in S730. In S730, processes of S643–S645 (FIG. 4) are repeatedly conducted to modify the scan data groups and the sheet-feed amounts to be used in the plural scan printing operations. Thus, in S730, a plurality of modified scan data groups are produced to be used during the successive scam printing operations, and a plurality of sheet-feed amounts, by which the sheet 200 will be fed before the successive scan printing operations, are determined.

In S740, the predetermined number of page is printed by successively performing the scan printing operations using the thus prepared scan data groups while successively feeding the sheet 200 by the thus prepared sheet-feed amounts.

On the other hand, if it is determined that there is no nozzle N that will be used less than the threshold number Th of times (no in S720), the scan data for the subject predetermined number of page is not rewritten or the sheet-feed amount is not changed, but successive scan printing operations are performed in S740 based on the non-adjusted scan data groups and based on the non-adjusted, predetermined sheet-feed amounts (I×n) for the subject predetermined number of pages.

Then, in S750, it is checked whether any print data remains unprinted in the reception buffer 401. The processes of S700–S750 are executed until no print data remains unprinted in the reception buffer 401.

For example, when desiring to print one page by printing lines D1–D21 as shown in FIG. 5 according to this modification, first, in S700, print data for all the lines D1–D21 is read out from the reception buffer 41, converted into successive groups of scan data, and stored in the scan data buffer 403. In this example, the successive groups of scan data are prepared so that the nozzles N1–N8 will be used in a first scan printing to print lines D1–D8, the nozzles N1–N8 will then be used in a second scan printing to print lines D9–D16, and then the nozzles N1–N5 will be used in a third scan printing to print lines D17–D21.

In S710, the thus prepared scan data is examined to detect the number of times each nozzle N1–N8 will be used to eject ink to print all the lines D1–D21. If the nozzle N5 is detected as a nozzle that will be used less than the threshold number of times Th (yes in S720), the scan data is modified in S730 so that the nozzles N1–N8 will be used in a first scan printing to print lines D1–D8 (print region L1), the nozzles N4–N8 will then be used in a second scan printing to print lines D9–D13 (print region L3), and then the nozzles N1–N8 will be used in a third scan printing to print lines D14–D21 (print region L4). The sheet feed amount is prepared so that the sheet 200 will be fed by the distance equivalent to the region L3 before printing the region L3 and so that the sheet will be fed by the distance equivalent to the region L4 before printing the region L4.

According to this modification, therefore, the scan data rewrite processor 406 allocates scan data to the nozzles so that each nozzle will be used at least the threshold number Th of times, while the predetermined number of page's worth of image is printed. For example, when the user sets one (1) as the threshold number Th, it is ensured that each nozzle will be used at least once, while the predetermined number of page (one page, in this example) is printed.

The above description is directed to the example where the predetermined number of page is one page. However, the predetermined number of page may be more than one page. In this case, it is ensured that each nozzle will be used at least the threshold number Th of times, while more than one pages' worth of image is printed.

In the above description, the threshold number Th is optionally set by the user. Accordingly, the user can set his/her desired number of times that each nozzle should be used while the predetermined one or more pages are printed. However, the threshold number Th may be previously set to a predetermined fixed value. For example, the threshold number Th may be previously set to a value of (1). Also in this case, it is ensured that each nozzle will be used at least once, while the predetermined number of page is printed.

Second Modification

In the above-described first modification, the scan data buffer 403 has the memory area for storing scan data groups for printing one or more predetermined number of pages. However, the scan data buffer 403 may nave any desired memory area for storing any desired plural scan data groups. It is unnecessary that the plurality of scam data groups are for printing some exact page(s). Also in such a case, every time the scan data preparation processor 402 prepares a plurality of scan data groups, the scan data preparation processor 402 may store the scan data groups in the scan data buffer 403.

It is noted that before starting a plurality of successive printing operations by using the plural scan data groups, it is possible to examine the plural scan data groups and so determine whether each nozzle will not be used for long periods of time while the successive plural scan printing operations are executed. If a nozzle that will not be used for long periods of time is found, the present modification rewrites the plural groups of scan data and changes the sheet feed amount so that the nozzle will be sufficiently frequently used while the plural scan printing operations are executed.

Figure 7:
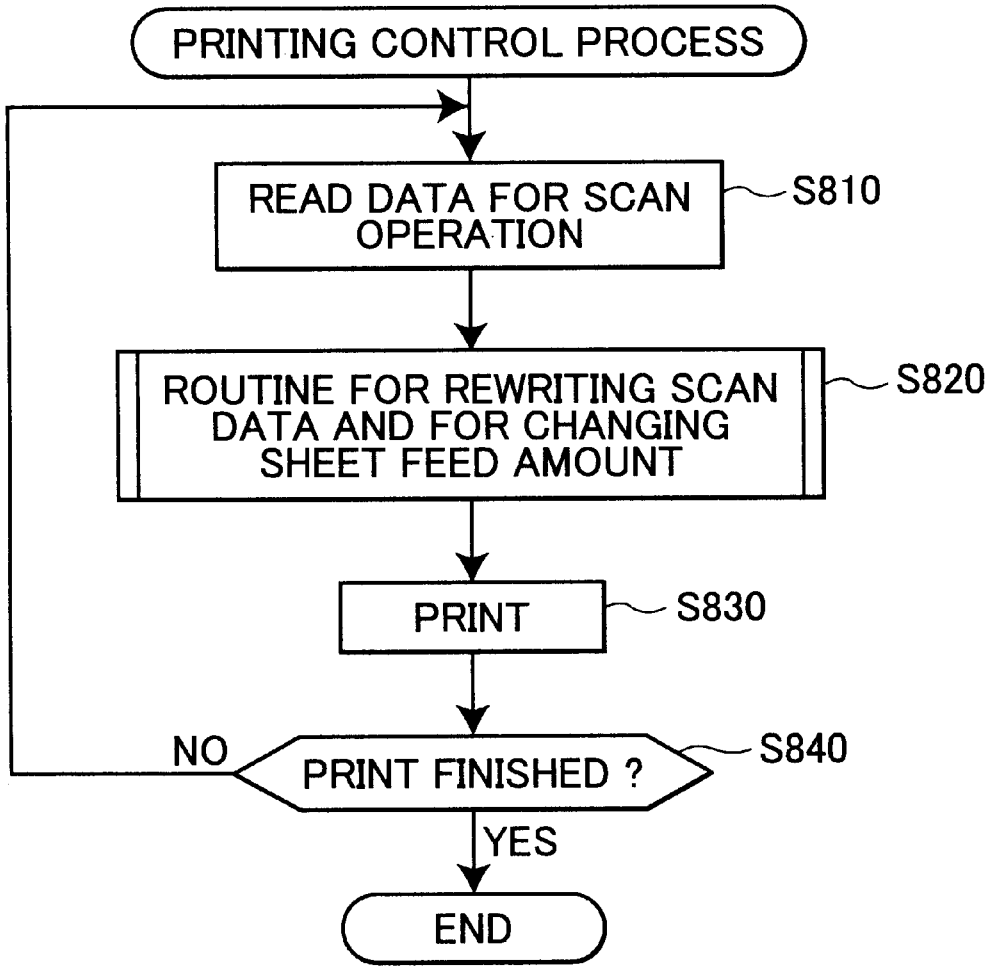
FIG. 7 is a flow chart showing a print control process according to a second modification.

According to this modification, the printing control is performed as shown in FIG. 7.

It is assumed that the scan data buffer 403 can store U-number of scan data groups (the first through U-th scan data groups), wherein U is an integer greater than one (1). The first through U-th scan data groups will be used in succession during U-number of scan printing operations (the first through U-th scan printing operations).

It is desired to prevent each nozzle from not being used continuously during a predetermined period of time T. The time period T is equal to the time length required to perform R-number of successive printing operations (wherein R is an integer greater than zero (0) and smaller than or equal to U). The predetermined period of time T therefore has a value of S×R, wherein S is the maximum period of time required to perform one scan printing operation.

Although not shown in the drawing, the scan data rewrite processor 406 is provided with a plurality of tables in one to one correspondence with the plurality of nozzles. The scan data rewrite processor 406 is also provided with a plurality of counters in one to one correspondence with the plurality of tables.

First, in S810, the scan data preparation processor 402 reads print data, for U-number of successive scan printing operations, from the reception buffer 401, and converts the print date into U-number of groups of scan data so that the U-number of groups of scan data will be successively used in the U-number of scan printing operations. The thus prepared scan data groups are stored in the scan data buffer 403.

Then, the program proceeds to the routine of S820 for selectively rewriting scan data and changing sheet-feed amount.

Next, in S830, the U-number of scan printing operations are conducted successively by using the thus selectively-rewritten scan data groups while successively feeding the sheet 200 by the selectively-changed sheet-feed amounts.

Then, in S840, it is checked whether any print data remains unprinted in the reception buffer 401. The processes of S810–S840 are executed until no print data remains unprinted in the reception buffer 401.

Next, the scan data rewrite and sheet-feed amount change process of S820 will be described in greater detail while referring to FIG. 8.

First, in S821, the scan data rewrite processor 406 examines all the U-number of scan data groups, stored in the scan data buffer 403, to determine whether there is some nozzle N that will not be used for the predetermined period of time T while the U-number of successive scan printing operations are conducted by using the scan data groups.

More specifically, the scan data rewrite processor 406 examines all the U-number of scan data groups in succession. By examining one scan data group, the scan data rewrite processor 406 knows which nozzle is scheduled to be used for ejecting ink during the corresponding scan printing operation. Accordingly, every time the scan date rewrite processor 406 has finished examining one scan data group, the scan data rewrite processor 406 sets the value of "1" to the tables for ink-ejecting nozzles, and sets the value of "0" to the table for other remaining nozzle. Each counter monitors the corresponding table, and counts the number of times that the value of "0" is continuously set in the corresponding table.

In this example, it is assumed that the number counted by one counter, which corresponds to a table for some nozzle, reaches the value "R" after the scan data rewrite processor 406 has finished examining the "u"-th scan data group to be used during the "u"-th scan printing operation, wherein "u" is an integer greater than or equal to one and smaller than or equal to U.

After examining all the U-number of scan data groups, the program proceeds to S822. In S822, the scan data rewrite processor 406 determines whether or not there is some nozzle N that will not be used for the predetermined period of time T, by judging whether or not there is some counter whose counted value has reached a value greater than or equal to the number "R" during the examination procedure of S822. In this example, it is determined that there exists the unused nozzle N because its corresponding counter N has reached the number "R" after examination of the "u"-th scan data group.

If there is some nozzle N that will not be used for the predetermined period of time T (yes in S822), the program proceeds to S823.

In S823, the scan data rewrite processor 406 determines when the nozzle N will not be used continuously for the predetermined period of time T, by judging when the number counted by the counter N hag reached the value "R". In this example the counter N has reacted the value "R" after the examination of the u-th scan data group. Accordingly, the scan data rewrite processor 406 knows that the nozzle N will not be used continuously for the predetermined period of time T if the (u−R+1)-th through u-th scan printing operation were executed by using the (u−R+1)-th through u-th scan data groups as they are.

Next in S824, the scan data rewrite processor 496 searches through all the U-number of scan data groups in the scan data buffer 403 to find out one line's worth of replacement scan data and to set a corresponding nozzle as a replacement nozzle M. It is noted that the one line's worth of replacement scan data is defined as one set of scan data that includes data for ejecting ink, that is included in either one of the U-number of scan data groups, and that is to be used by the replacement nozzle N different from the unused nozzle N. More specifically, the one line's worth of replacement scan data is defined as one set of line data that is for printing a one line on the print sheet 200 at a location that the unused nozzle N can print when the position of the unused nozzle N is adjusted by changing the sheet-feed amount from the predetermined sheet-feed amount (I×n).

It is preferable that the scan data rewrite processor 406 sets, as the one line's worth of replacement scan data, such a set of line data that can be printed by the unused nozzle N by changing the sheet-feed amount in the most efficient manner.

For example, the scan data rewrite processor 406 may perform the operation described below. It is noted that the unused nozzle N will create a blank line during the u-th scan printing operation. Accordingly, the scan data rewrite processor 406 first finds out one or more ink-ejection line that will be printed on the print sheet 200 by using nozzles other than the unused nozzle N at a location on the downstream side of the blank line in the sheet feeding direction. The scan data rewrite processor 406 then selects one ink-ejection line that is nearest to the blank line among the found out one or more ink-ejection line. The scan data rewrite processor 406 then sets data of the selected line as the one line's worth of replacement data. The scan data rewrite processor 406 then sets the corresponding nozzle as the replacement nozzle M.

Accordingly, if the u-th scan data group includes ink-ejection data at nozzle positions with nozzle numbers smaller than that of the unused nozzle N, in the same manner as in the above-described embodiment, the scan data rewrite processor 406 first sets those nozzles as nozzle candidates, and then sets, as the replacement nozzle M, one nozzle that is located nearest to the unused nozzle N among the nozzle candidates.

On the other hand, if the u-th scan data group includes no ink-ejection data at nozzle positions with nozzle numbers smaller than the unused nozzle N, the scan data rewrite processor 406 finds out one or more scan data group that has a group number smaller than "u" and therefore that will be used prior to the u-th scan data group and that includes at least one set of ink-election data at nozzle positions other than the unused nozzle N position. The scan data rewrite processor 406 selects one scan data group ("v"-th scan data group (where $1 \leqq v < u$)) that is the nearest to the u-th scan data group among the found out one or more scan data group. The scan data rewrite processor 406 then searches through the selected v-th scan data group. The scan data rewrite processor 406 finds out one or more ink-ejecting nozzles for the v-th scan printing operation, and sets, as the replacement nozzle M, one ink-ejecting nozzle with the greatest nozzle number among the found out one or more ink-ejecting nozzles.

Next, in S825, a nozzle data replacement process is executed for rewriting the scan data to replace the scan data so that the unused nozzle N will be used to print the replacement scan data instead of the replacement nozzle M.

For example, if both of the unused nozzle N and the replacement nozzle M are set in the u-th scan printing operation, scan data for the u-th scan printing operation is replaced, in the same manner as in S644 (FIG. 4) of the above-described embodiment, so that the unused nozzle N will be used to perform ink election instead of the replacement nozzle M during the u-th scan printing operation. On the other hand, if the replacement nozzle M Is set in the v-th scan printing operation different from the u-th scan printing operation, scan data for the v-th scan printing operation is replaced, in the same manner as in S644 (FIG. 4) of the above-described embodiment, so that the unused nozzle N will be used to perform ink ejection instead of the replacement nozzle M during the v-th scan printing operation.

In S826, the U-number of groups of scan data, stored in the scan data buffer 403, are updated using the scan data replaced in S525.

For example, if the scan data for the u-th scan printing operation is replaced in S625 so that the unused nozzle N will be used instead of the replacement nozzle M, the u-th scan data group and its subsequent data groups are rewritten, in the same manner as in the above-described embodiment, so that their corresponding successive lines will be printed properly. On the other hand, if the scan data for the v-th scan printing operation is replaced so that the unused nozzle N will be used instead of the replacement nozzle M, the v-th scan data group and its subsequent data groups are rewritten, in the same manner as in the above-described embodiment, so that corresponding successive lines will be printed properly.

In S827, the sheet-feed amounts, to be respectively used for the U-number of scan printing operations, are modified from the predetermined sheet-feed amount (I×n), based on the positional relationship between the unused nozzle N and the replacement nozzle M in the same manner as in the above-described embodiment.

For example, if the u-th scan data group and its subsequent data groups are rewritten, the sheet-feed amount to be used for the u-th scan printing operation is reduced from the predetermined sheet-feed amount (I×n) by the distance (I×(N−M)) between the unused nozzle N and the replacement nozzle M. If the v-th scan data group and its subsequent data groups are rewritten, the sheet-feed amount to be used for the v-th scan printing operation is reduced from the predetermined sheet-feed amount (I×n) by the distance (I×(N−M)) between the unused nozzle N and the replacement nozzle M.

Data of the thus selectively-changed sheet-feed amounts is stored in the scan data buffer 403 or a data storage medium (not shown) provided to the scan data rewrite processor 406.

Then, the scan data rewrite and sheet-feed amount change routine of S820 is finished. The program returns to the main routine of FIG. 7. The U-number of scan printing operations are successively executed in S830 by using the modified scan data groups and by using the changed sheet-feed amounts. In order to execute each scan printing operation, the print sheet 200 is fed by the corresponding sheet-feed amount, and then the heads 101–104 are driven to eject ink based on the corresponding scan data group.

On the other hand, if there is no unused nozzle N that will not be used for the predetermined period or time T (no in S822), the scan data rewrite and sheet-feed amount changing routine of S820 is immediately finished, without modifying the scan data groups or changing the sheet-feed amount. Accordingly, the U-number of scan printing operations are successively executed in S830 by using the unmodified scan data groups and by using the predetermined sheet-feed amount (I×n). In order to execute each scan printing operation, therefore, the print sheet 200 is fed by the predetermined sheet-feed amount, and then the heads 101–104 are driven to eject ink based on the corresponding scan data group.

According to this modification, therefore, even if the u-th group of scan data has no data for ejecting ink, it is possible to search the replacement scan data in scan data groups other than the u-th group of scan data. By replacing the scan data so that the unused nozzle will be used to print the replacement scan data, it is possible to allow the unused nozzle to eject ink. It is therefore unnecessary to execute a refreshment operation.

It is noted, however, that there will possibly arise the case where a large number of unused nozzles N are determined in S822. In this case, it is impossible to properly modify the scan data to allow the many unused nozzles to eject ink. In this case, a refreshment operation may be conducted.

It is noted that if the value R is equal to the value U and therefore the predetermined period of time T is equal to the amount of S×U, when the process of S821 is finished, the table for the unused nozzle N is still maintained as zero (0). Accordingly, in S822, it is possible to determine whether or not some unused nozzle N exists, by judging the state of the tables after the process of S821 is finished. It is therefore unnecessary to provide the counter for each table.

Figure 8:
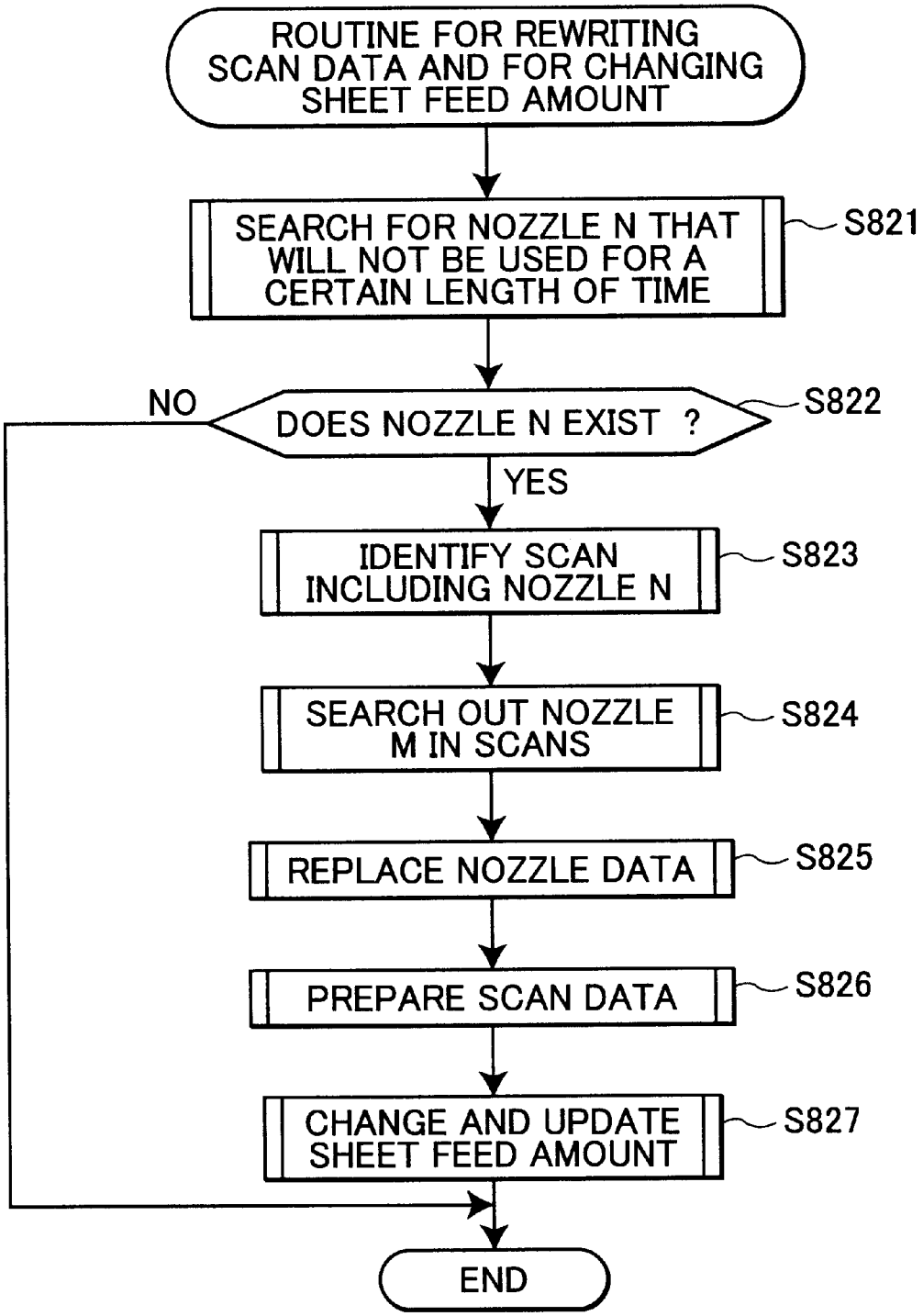
FIG. 8 is a detailed flow chart showing the scan data rewrite and sheet-feed amount changing process in the control process of FIG. 7.

It is noted that the processes of S710–S730 (FIG. 6) in the first modification can be modified into the process of S820 in FIGS. 7 and 8 to execute the scan data rewrite and sheet-feed amount change operation in the same manner as in the second modification.

As described above, according to the embodiment and modifications, when a nozzle which is not used frequently in a printing operation is detected, scan data is rewritten and an amount of sheet feed is changed. By controlling nozzles that is not used so that they are used for printing, ink can be prevented from being drying in the nozzles. Moreover, no or fewer refreshment operations are required. This reduces the amount that ink is consumed. Also, because refreshment operations require temporarily stopping printing operations, it is possible to decrease reduction in printing speed by not performing the refreshment operations. In this way, all nozzles can be thoroughly used to perform printing operations, and no or fewer refresh operations, which require temporarily stopping printing operations, are needed. This prevents reducing the amount that the printing speed is reduced and wasting amount of the ink consumption.

While the invention has been described in detail with reference to the specific embodiment thereof, it would be apparent to those skilled in the art that various changes and modifications may be made therein without departing from the spirit of the invention.

For example, in the above-described embodiment, the four heads 101 to 104 are mounted on the carriage 105. However, the total number of heads can vary depending on the design of the printer.

In the above-described embodiment, the scan data rewrite processor 406 executes scan date rewrite processes on the scan data stored in the scan data buffer 403. However, the scan data rewrite processor 406 may change the manner now the scan data preparation processor 402 prepares scan data based on print data. The same results as the above-described embodiment can be attained.

In the above-described embodiment, when the program proceeds from S640 to S650, the scan data group modified in S640 is analyzed, and timers for all the ink-ejecting nozzles are reset and restarted. However, because the timer for the unused nozzle N is already reset and restarted in S647 in the process of S640, the process of S650 may be modified so that the timers for the ink-ejecting nozzles, other than the unused nozzle N, may be reset and restarted.

What is claimed is:

1. An ink jet recording device, comprising:

a print head formed with a plurality of nozzles arranged in a first predetermined direction;

a print head scanning mechanism scanning the print head in a second predetermined direction substantially perpendicular to the first predetermined direction;

a sheet feeding mechanism feeding a print sheet relative to the print head in a sheet feeding direction that is substantially parallel to the first predetermined direction;

a print engine driving the print head to perform successive scan printing operations to eject ink from the nozzles, the print engine driving the sheet feeding mechanism to feed the print sheet before controlling the print head to perform each scan printing operation; and a print controller controlling the print engine, the print controller including:

a scan data preparation processor preparing scan data for each scan printing operation, based on the nozzle configuration of the print head and based on print data;

a sheet transportation processor controlling a sheet feed amount, by which the sheet feeding mechanism feeds the print sheet;

a detecting unit detecting how each nozzle is used in the successive scan printing operations; and a scan data rewriting unit rewriting the scan data and craning the amount of sheet feed selectively based on the detected result.

2. An ink jet recording device as claimed in claim 1, wherein the detecting unit detects, before starting one scan printing operation, whether some nozzle has not been used for a predetermined period of time, wherein when the detecting unit detects some unused nozzle that has not been used for the predetermined period of time, the scan data rewriting unit rewrites the scan data for the subject scanning operation so as to use the detected unused nozzle during the subject scanning operation, and changes, from a predetermined amount, the amount of sheet feed, by which the sheet is to be fed before the subject scan printing operation, in accordance with the rewritten scan data, and wherein when the detecting unit detects no unused nozzle, the scan data rewriting unit performs no rewriting operation and performs no sheet feed amount changing operation.

3. An ink jet recording device as claimed in claim 2, wherein the detecting unit includes a time duration detection unit detecting whether each nozzle has not been used for the predetermined period of time.

4. An ink jet recording device as claimed in claim 2, wherein the scan data rewriting unit includes:

a scan data replacing unit allocating, to the detected unused nozzle, scan data for a replacement nozzle that is different from the unused nozzle and that is to eject ink in the subject scan printing operation; and a sheet feed amount changing unit changing the amount of sheet feed, from the predetermined amount that corresponds to a distance covering all the plurality of nozzles, by an amount corresponding to a distance between the unused nozzle and the replacement nozzle.

5. An ink jet recording device as claimed in claim 4, wherein the replacement nozzle is located in a downstream side of the unused nozzle in the sheet feeding direction.

6. An ink jet recording device a claimed in claim 5, wherein the scan data replacing unit includes:

a searching unit searching at least one candidate nozzle that is to eject ink in the subject scan printing operation and that in located in the downstream side of the unused nozzle in the sheet feeding direction; and a determining unit selecting, among the at least one candidate nozzle, one nozzle that is located closest to the unused nozzle, and determining the selected one nozzle as the replacement nozzle.

7. An ink jet recording device as claimed in claim 6, wherein a series of successive nozzle numbers are assigned to the plurality of nozzles in a manner that the nozzle number increases in a direction opposite to the sheet feeding direction, wherein the searching unit searches the at least one candidate nozzle that has nozzle number smaller than the nozzle number of the unused nozzle, and wherein the determining unit selects, among the at least one candidate nozzle, one nozzle whose nozzle number is the nearest to the nozzle number of the unused nozzle.

8. An ink jet recording device as claimed in claim 7, wherein the scan data preparation processor prepares the scan data for the subject scan printing operation so that the scan data includes successive lines' worth of scan data in one to one correspondence with the plurality of nozzles, and wherein the scan data replacing unit further includes:

a data-nozzle correspondence changing unit changing a correspondence relationship between the plurality of nozzles and the successive lines' worth of scan data by shifting the plurality of nozzles relative to the successive lines' worth of scan data by an amount equivalent to the difference between the nozzle number of the unused nozzle and the nozzle number of the replacement nozzle so that the unused nozzle will correspond to one line's worth of scan data that has been prepared for the replacement nozzle; and a non-ejection data setting unit setting non-ejection data onto all or at least one successive nozzle, the total number of which is equal to the difference between the nozzle number of the unused nozzle and the nozzle number of the replacement nozzle and which includes the nozzle with the smallest nozzle number.

9. An ink jet recording device as claimed in claim 8, wherein the scan data preparation processor prepares the scan data for the subject scan printing operation so that a series of successive line numbers are assigned to the successive lines' worth of scan data, the line number increasing in a direction opposite to the sheet feeding direction, and so that the successive lines' worth of scan data with the series of successive line numbers are assigned in one to one correspondence with the series of successive nozzle numbers, and wherein the data-nozzle correspondence changing unit assigns the one line's worth of scan data, which has a replacement line number that corresponds to the nozzle number of the replacement nozzle, to the unused nozzle, and assigns succeeding lines' worth of scan data, whose line number is greater than the replacement line number, to succeeding nozzles whose nozzle number is greater than the nozzle number of the unused nozzle.

10. An ink jet recording device as claimed in claim 1, wherein the scan data rewriting unit rewrites the scan data so that each nozzle will be used at least once while several scan printing operations are successively conducted to print a predetermined number of page's worth of image.

11. An ink jet recording device an claimed in claim 10, wherein the detecting unit detects, before starting the several scan printing operations to print the predetermined number of page's worth of image, whether some nozzle will be used less than a threshold number of times, and wherein when the detecting unit detects that some nozzle will be used less than the threshold number of times, the scan data rewriting unit rewrites the scan data for the several scan printing operations so as to use the detected nozzle at least the threshold number of times during the several scan printing operations, and changes the amount of sheet feed, by which the sheet is to be fed during the several scan printing operations, based on the rewritten scan data.

12. An ink jet recording device as claimed in claim 10, wherein the predetermined number of page is one page.

13. An ink jet recording device as claimed in claim 10, wherein the predetermined number of page is more than one page.

14. An ink jet recording device as claimed in claim 11, wherein the threshold number is one.

15. An ink jet recording device as claimed in claim 11, further comprising a setting unit enabling a user to optionally set the threshold number.

16. An ink jet recording device as claimed in claim 1, further comprising a scan data buffer capable of storing one group of scan data to be used during the present scan printing operation to be conducted, wherein the detecting unit detects, after completing a preceding scan printing operation and before starting the present scan printing operation, whether some nozzle has not been used for a predetermined period of time, wherein when the detecting unit detects some unused nozzle that has not been used for the predetermined period of time, the scan data rewriting unit rewrites the scan data for the present scanning operation so as to use the detected unused nozzle during the present scanning operation, and changes, from a predetermined amount, the amount of sheet feed, by which the sheet is to be fed before the present scan printing operation, in accordance with the rewritten scan data, and wherein when the detecting unit detects no unused nozzle, the scan date rewriting unit performs no rewriting operation and performs no sheet feed amount changing operation.

17. An ink jet recording device as claimed in claim 16, wherein the scan data rewriting unit includes:

a scan data searching unit searching the scan data group, stored in the scan data buffer, to determine a replacement nozzle that is different from the unused nozzle and that is to eject ink in the present scan printing operation;

a scan data replacing unit allocating scan data for the replacement nozzle to the detected unused nozzle; and a sheet feed amount changing unit changing the amount of sheet feed based on the positional relationship between the replacement nozzle and the unused nozzle.

18. An ink jet recording device as claimed in claim 1, further comprising a scan data buffer capable of storing a plurality of groups of scan data to be used during a plurality of successive scan printing operations to be conducted, wherein the detecting unit includes an analyzing unit analyzing, before starting the plurality of scan printing operations, the plurality of groups of scan data stored in the scan data buffer, to thereby determine whether some nozzle will not be used for a predetermined period of time during the plurality of scan printing operations, wherein when the analyzing unit determines that some nozzle will not be used for the predetermined period of time, the scan data rewriting unit rewrites the plurality of scan data groups so as to use the detected nozzle within the predetermined period of time during the plurality of scan printing operations, and changes the amount of sheet feed, by which the sheet is to be fed during the plural scan printing operations, based on the rewritten scan data, and wherein when the analyzing unit determines no unused nozzle, the scan data rewriting unit perform no rewriting operation and performs no sheet feed amount changing operation.

19. An ink jet recording device as claimed in claim 18, wherein the scan data rewriting unit includes:

a scan date searching unit searching the plural scan data groups, stored in the scan data buffer, to determine a replacement nozzle that is different from the unused nozzle and that is to eject ink in either one of the plural scan printing operations;

a scan data replacing unit allocating scan data for the replacement nozzle to the detected unused nozzle; and a sheet feed amount changing unit changing the amount of sheet feed based on the positional relationship between the replacement nozzle and the unused nozzle.

20. A method of controlling an ink jet recording device, the ink jet recording device including: a print head formed with a plurality of nozzles arranged in a first predetermined direction; a print head scanning mechanism scanning the print head in a second predetermined direction substantially perpendicular to the first predetermined direction; a sheet feeding mechanism feeding a print sheet relative to the print head in a sheet feeding direction that is substantially parallel to the first predetermined direction; and a print engine driving the print head to perform successive scan printing operations to eject ink from the nozzles, the print engine driving the sheet feeding mechanism to feed the print sheet before controlling the print head to perform each scan printing operation; the method comprising the steps of:

preparing scan data for each scan printing operation, based on the nozzle configuration of the print head and based on print data;

detecting how each nozzle is used in the successive scan printing operations;

rewriting the scan data and changing the amount of sheet feed selectively based on the detected result; and controlling the print engine to drive the sheet feeding mechanism to feed the print sheet by the selectively-rewritten sheet feed amount, and controlling the print engine to drive the print head to eject ink based on the selectively-rewritten scan data.

21. A method as claimed in claim 20, wherein the detecting step detects, before starting one scan printing operation, whether some nozzle has not been used for a predetermined period of time, wherein when the detecting step detects some unused nozzle that has not been used for the predetermined period of time, the scan data rewriting step rewrites the scan data for the subject scanning operation so as to use the detected unused nozzle during the subject scanning operation, and changes, from a predetermined amount, the amount of sheet feed, by which the sheet is to be fed before the subject scan printing operation, in accordance with the rewritten scan data, and wherein when the detecting step detects no unused nozzle, the scan data rewriting step performs no rewriting operation and performs no sheet feed amount changing operation.

22. A method as claimed in claim 20, wherein the scan data rewriting step rewrites the scan data so that each nozzle will be used at least once while several scan printing operations are successively conducted to print a predetermined number of page's worth of image.

23. A method as claimed in claim 22, wherein the detecting step detects, before starting the several scan printing operations to print the predetermined number of page's worth of image, whether some nozzle will be used less than a threshold number of times, and wherein when the detecting step detects that some nozzle will be used less than the threshold number of times, the scan data rewriting step rewrites the scan data for the several scan printing operations so as to use the detected nozzle at least the threshold number of times during the several scan printing operations, and changes the amount of sheet feed, by which the sheet is to be fed during the several scan printing operations, based on the rewritten scan data.

24. A method as claimed in claim 23, further comprising a step of optionally setting the threshold number.

25. A method as claimed in claim 20, wherein the scan data preparing step prepares one group of scan data to be used during the present scan printing operation to be conducted, and stores the scan data group in a scan data buffer, wherein the detecting step detects, after completing a preceding scan printing operation and before starting the present scan printing operation, whether some nozzle has not been used for a predetermined period of time, wherein when the detecting step detects some unused nozzle that has not been used for the predetermined period of time, the scan data rewriting step rewrites the scan data for the present scanning operation so as to use the detected unused nozzle during the present scanning operation, and changes, from a predetermined amount, the amount of sheet feed, by which the sheet is to be fed before the present scan printing operation, in accordance with the rewritten scan data, and wherein when the detecting step detects no unused nozzle, the scan data rewriting step performs no rewriting operation and performs no sheet feed amount changing operation.

26. A method as claimed in claim 25, wherein the scan data rewriting step includes the steps of:

searching the scan data group, stored in the scan data buffer, to determine a replacement nozzle that is different from the unused nozzle and that is to eject ink in the present scan printing operation;

allocating scan data for the replacement nozzle to the detected unused nozzle; and changing the amount of sheet feed based on the positional relationship between the replacement nozzle and the unused nozzle.

27. A method de claimed in claim 20, wherein the scan data preparing step prepares a plurality of groups of scan data to be used during a plurality of successive scan printing operations to be conducted, and stores the scan data groups in a scan data buffer, wherein the detecting step includes the step of analyzing, before starting the plurality of scan printing operations, the plurality of groups of scan data in the scan data buffer, to thereby determine whether some nozzle will not be used for a predetermined period of time during the plurality of scan printing operations, wherein when the analyzing step determines that some nozzle will not be used for the predetermined period of time, the scan data rewriting step rewrites the plurality of scan data groups so as to use the detected nozzle within the predetermined period of time during the plurality of scan printing operations, and changes the amount of sheet feed, by which the sheet is to be fed during the plural scan printing operations, based on the rewritten scan data, and wherein when the analyzing step determines no unused nozzle, the scan data rewriting step performs no rewriting operation and performs no sheet feed amount changing operation.

28. A method as claimed in claim 27, wherein the scan data rewriting step includes the steps of:

searching the plural scan data groups, stored in the scan data buffer, to determine a replacement nozzle that is different from the unused nozzle and that is to eject ink in either one of the plural scan printing operations;

allocating scan data for the replacement nozzle to the detected unused nozzle; and changing the amount of sheet feed based on the positional relationship between the replacement nozzle and the unused nozzle.

* * * * *